United States Patent [19]

Villa

[11] Patent Number: 4,893,089

[45] Date of Patent: Jan. 9, 1990

[54] PULSE POWER LINAC

[75] Inventor: Francesco Villa, Alameda, Calif.

[73] Assignee: Harris Blake Corporation, Great Neck, N.Y.

[21] Appl. No.: 244,121

[22] Filed: Sep. 14, 1988

[51] Int. Cl.[4] ..... H05H 5/00

[52] U.S. Cl. ..... 328/233; 328/228; 328/112; 328/114

[58] Field of Search ..... 313/228, 233, 114, 116, 313/111, 112

[56] References Cited

U.S. PATENT DOCUMENTS 4,398,156 8/1983 Aaland ..... 328/233

4,570,103 2/1986 Schoen ..... 328/233 X

*Primary Examiner*—Kenneth Wieder

*Attorney, Agent, or Firm*—Ostrolenk, Faber, Gerb & Soffen

[57] ABSTRACT

A linear acceleration for charged particles is constructed of a plurality of transmission line sections that extend between a power injection region and an accelerating region. Each line section is constructed of spaced plate-like conductors and is coupled to an accelerating gap located at the accelerating region. Each gap is formed between a pair of apertured electrodes, with all of the electrode apertures being aligned along a particle accelerating path. The accelerating gaps are arranged in series, and at the injection region the line sections are connected in parallel. At the injection region a power pulse is applied simultaneously to all line sections. The line sections are graduated in length so that the pulse reaches the gaps in a coordinated sequence whereby pulse energy is applied to particles as they reach each of the gaps along the accelerating path.

17 Claims, 6 Drawing Sheets

10
11-4
11-3
11-2
11-1
12
16
17
18
19
21-4
21-3
21-2
21-1
22-4
22-3
22-2
22-1
23
24
26
29
31
32-4
32-3
32-2
32-1
98
99
100
C
PARTICLE GENERATOR
S.D.
E.S.
E.S. = ENERGY SOURCE
S.D. = STORAGE & POWER COMPRESSION DEVICE

PULSE POWER LINAC

The Government has rights in this invention pursuant to Contract No. De-AC03-76SF00515 - MODIFICATION No. M162 awarded by the U.S. Department of Energy.

BACKGROUND OF THE INVENTION

This invention relates to linear accelerators in general and relates more particularly to a LINAC that is powered by pulses of energy rather than by RF power.

In the field of particle accelerators, circular machines are used widely because of the convenience involved when imparting energy to particles traveling in a repetitive circular orbit. However, at relatively high energy levels, say above 100GeV, because of synchrotron radiation losses the use of circular machines for electron acceleration is just about precluded. Thus, the possibility of utilizing linear accelerators (LINAC) is being explored more than ever.

While switch power or pulse power LINACS are known, for the most part, particle accelerators of the prior art have utilized RF switching power compression schemes. A switch power LINAC structure is disclosed by W. Willis in an article appearing on pages 166–174 of the Proceedings of the SAS-ECFA-INFN Workshop, Frascati, Sept. 1984. The Willis device consists of a set of parallel discs each having a hole through which the electron beam is accelerated by an electromagnetic wave which is injected uniformly in appropriate phase at the periphery of the discs. The wave is compressed spatially as it travels towards the holes at the center of the discs.

In a Willis type structure the energizing wave front that is injected must be uniform around the periphery of the discs or else transverse fields will be experienced by the particles that are being accelerated. Further, the electric field obtained at the center of the disks depends upon the ratio g/tc (g is the distance between the two disks, c the speed of light, t the rise-time of the pulse). The dependence is such that in order to obtain a substantial gain in electric field at the disk's center, the injected pulse must have a fast risetime (faster than g/c). This requires a costly switching system combined with fast risetime requirements, high peak power and a circular switching configuration. As will hereinafter be seen, the LINAC constructed in accordance with teachings of the instant invention does not require extremely fast risetime for the input power pulses in order to achieve high gradients efficiently, and recovery of energy that is not consumed by particle acceleration may be achieved without interfering with input power switching. Further, to achieve equal accelerating gradients, in most cases a radial line device of the Willis type requires higher energy per unit length than does the LINAC of the instant invention.

SUMMARY OF THE INVENTION

The instant invention provides a LINAC that is constructed by arranging a plurality of accelerating gaps in series and energizing these gaps in sequence by releasing or switching a single pulse of energy which propagates simultaneously along a plurality of transmission lines each of which feeds an individual one of the gaps. The characteristics of the transmission lines are coordinated so that pulse power is present at each gap as the accelerated particle bunches pass therethrough.

This coordination is achieved by having each of the transmission lines impart a different delay to each portion of the power pulse. For achieving this type of coordination, the transmission lines are graduated in length with the shortest line feeding the first gap that the particle bunch passes through, the next gap being fed by a longer transmission line, the third gap being fed by an even longer transmission line, and so forth, so that the accelerating field is synchronized with movement of the particle bunch.

In accordance with the instant invention a parallel plate type transmission line structure is provided in which a single elongated three layer laminate, having outside conducting layers that are separated by an insulating layer or vacuum, is slit longitudinally at its central region to form a plurality of longitudinally extending ribbons, the central portions of which are twisted so that they lie at right angles to the plane in which the end portions of the laminate are disposed. The accelerating path extends through aligned apertures in the twisted sections and in this apertured area the insulating material is cut away. One unslit end portion at its free end is designated as a power injection region where an energy storage means and a switch for transferring stored energy to the transmission lines are disposed. A suitable switching device for this purpose is a Blumlein-like pulse forming network arrangement.

In effect, the transmission lines are connected in parallel at the power injection region and the accelerating gaps are in series.

Transit time control to obtain desired coordination between discharge of pulse power and application thereof to the electrodes that define the individual accelerating gap is achieved by varying the lengths of these plates and/or by varying the dielectric characteristic of the insulating material along the length thereof. The tapering and shaping of the transmission lines concentrates the energy available in the electrical pulse in a smaller volume, thereby increasing the value of the electric field.

Accordingly, the primary object of the instant invention is to provide an improved pulse power LINAC.

Another object is to provide a LINAC of this type in which power switching is simplified.

Still another object is to provide a LINAC of this type in which transmission lines are provided to achieve varying coordinated transit times for energy that travel from a common switching device to different accelerating gaps that are arranged in series.

A further object is to provide a LINAC of this type which will achieve high electric gradients.

A still further object is to provide a LINAC of this type having means for energy recovery which will avoid heating and/or damage to the switching means that is utilized to inject energy pulses.

BRIEF DESCRIPTION OF THE DRAWINGS

These objects as well as other objects of this invention shall become readily apparent after reading the following description of the accompanying drawings in which.

DETAILED DESCRIPTION OF THE INVENTION

Figure 1:
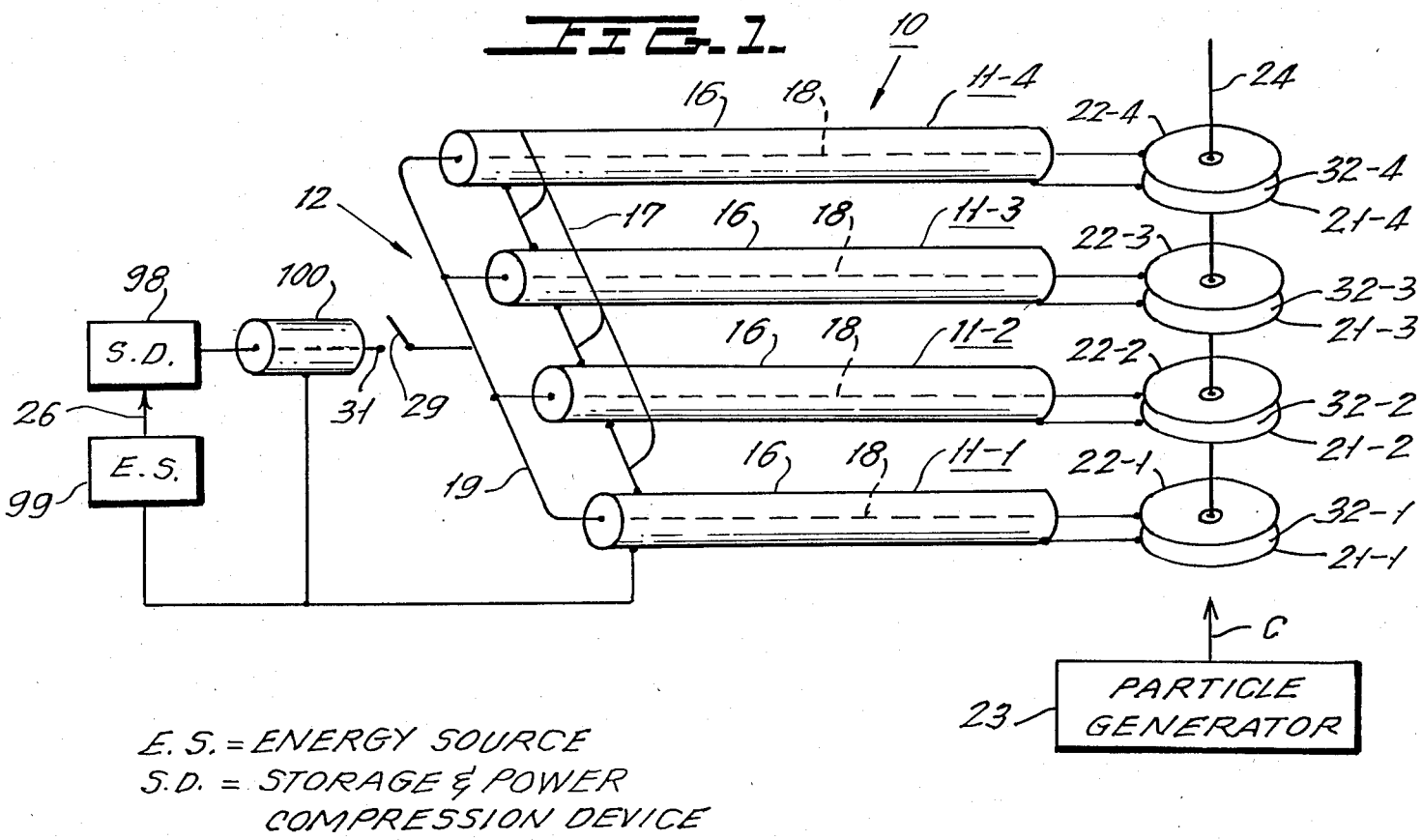
FIG. 1 is a schematic used to simplify explanation of the operating principles for the LINAC (FIGS. 2–8) constructed in accordance with teachings of the instant invention.

Now referring to the Figures and more particularly to FIG. 1 which illustrates schematically linear accelerator (LINAC) 10 that includes four coaxial transmission line sections 11-1, 11-2, 11-3 and 11-4 which extend from power injection region 12 to particle accelerating region 14. For a reason which will be seen hereinafter, coax sections 11-1, 11-2, 11-3 and 11-4 are of different lengths.

At power injection region 12 cylindrical outer conductors 16 of the coax sections are electrically connected to one another by jumpers 17 and central conductors 18 of the coax sections are shorted together by bus 19.

At accelerating region 14 there are a plurality of pairs of electrodes (21-1, 22-1), (21-2, 22-2), etc. that are aligned in a stack. Particle generator 23 emits particles which travel in a direction indicated by arrow C along linear path 24 that extends through aligned apertures in these pairs of stacked electrodes (21-1, 22-1), etc.

LINAC 10 is powered by pulses that are derived from energy source (E.S.) 99 whose output is applied to input 26 of storage and power compression device (S.D.) 98 to charge the device 98 Normally open switch 29 is interposed between bus 19 and energy output terminal 31 of pulse forming cable 100 having an input which is connected to the output of device 98. When switch 29 is closed the energy stored in device 98 discharges rapidly through pulse forming cable 100 to provide an energy pulse which is applied to bus 19 and thereby appears essentially simultaneous at central conductors 18 of all coax sections 11-1, 11-2, 11-3 and 11-4. The energy pulse propagates along coax section 11-1 and appears at electrode pair 21-1, 22-1 in that the respective outer and central conductors 16, 18 of coax section 11-1 are connected directly to the respective electrodes 21-1 and 22-1. Thus, a potential gradient exists across accelerating gap 32-1 formed between electrodes 21-1 and 22-1. The electric field existing in gap 32-1 imparts energy to particles from generator 23, which particles move across gap 32-1. Similarly, the conductors 16, 18 of each of the other coax sections 11-2, 11-3 and 11-4 are connected to the respective electrodes of another pair (21-2, 22-2), etc.

The energy pulse that is applied to bus 19 appears at accelerating gap 32-2 between the second pair of electrodes 21-2, 22-2 sometime after appearing at gap 32-1 because a greater transit time is required to traverse the longer coax section 11-2 than to traverse the shorter coax section 11-1. This time difference is such that when particles from generator 23 reach gap 32-1 there is a high voltage gradient thereacross and when these accelerated particles reach accelerating gap 32-2 a high voltage gradient appears thereacross. For the same reasons the energy pulse applied to bus 19 appears at gap 32-3 between electrodes 21-3, 22-3 and gap 32-4 between electrodes 21-4, 22-4 at a time when particles that have been accelerated while crossing gaps 32-1 and 32-2 are traveling across the respective gaps 32-3 and 32-4 so that these particles are further accelerated.

It should be apparent to those skilled in the art that the open termination configuration shown in FIG. 1 means that the voltage which appears across each of the accelerating gaps 32-1, 32-2, etc. will be twice the voltage that is applied to the coax input bus 19.

In accordance with the instant invention parallel plate type transmission line 35 (FIG. 2) is used for the propagation of energy from power injection region 36 to particle accelerating region 37, and from the latter to terminating region 38. More particularly, LINAC 30 of FIG. 2 includes spaced parallel plates 41, 42 which, in their longitudinal mid-regions are slit longitudinally to form narrow strips or ribbons 41-1–42-5 which are bent so that they are disposed in planes that are at right angles to the planes wherein the non-bent end portions of plates 41, 42 are disposed. At the center of each of the ribbons 41-1–42-5 there is an aperture 43 through which the generally straight line particle path 24 extends. The means for injecting power into LINAC 30 is illustrated schematically by charge storage plate 44 and normally open switch 45. Storage plate 44 is disposed between transmission line plates 41, 42 at power input region 36. While switch 45 is shown as being connected between plates 42 and 44 at one end of the latter, this is done only for ease of illustration. In a practical embodiment, it is intended that the elements of switch 45 extend the full length of storage plate 44 to assure that a power pulse will be applied simultaneously and uniformly across the entire width L of transmission line plates 41, 42.

In the portion of LINAC 30 between apertures 15 43 and the dashed line B-B' the slits which are cut in plates 41, 42 to form ribbons 41-1–42-5 commence at line B-B' which is nonparallel with respect to the end edges 41-6, 42-6 of the respected plates 41, 42. This means that it would take a power pulse that is injected at region 36 a longer time to reach ribbons 41-5, 42-5 than to reach ribbons 41-1, 42-1 This means that accelerating energy reaches the segment of accelerating path 24 between ribbons 41-1, 42-1 before reaching the segment between ribbons 41-5, 42-5 to effectively provide an energy gradient that appears to travel along accelerating path 24 in an upward direction with respect to FIG. 2.

The central portion of each of the ribbons 41-1–42-5 surrounding apertures 43 are the equivalent of the electrodes 21-1–22-4 in the embodiment of FIG. 1. The portion of LINAC 30 to the left of accelerating path 24 is designated as the input portion and the remainder of LINAC 30 (between path 24 and terminating region 38) is designated as the terminating portion, the latter being a mirror image of the former insofar as the configuration of transmission line plates 41, 42 is concerned. The energy that is left after particle acceleration can be recovered or at least removed from LINAC 30 after reaching end 46 of transmission line 41, 42 at terminating region 38, and by so doing switch 45 used to inject power will not be damaged by overheating.

Figure 3:
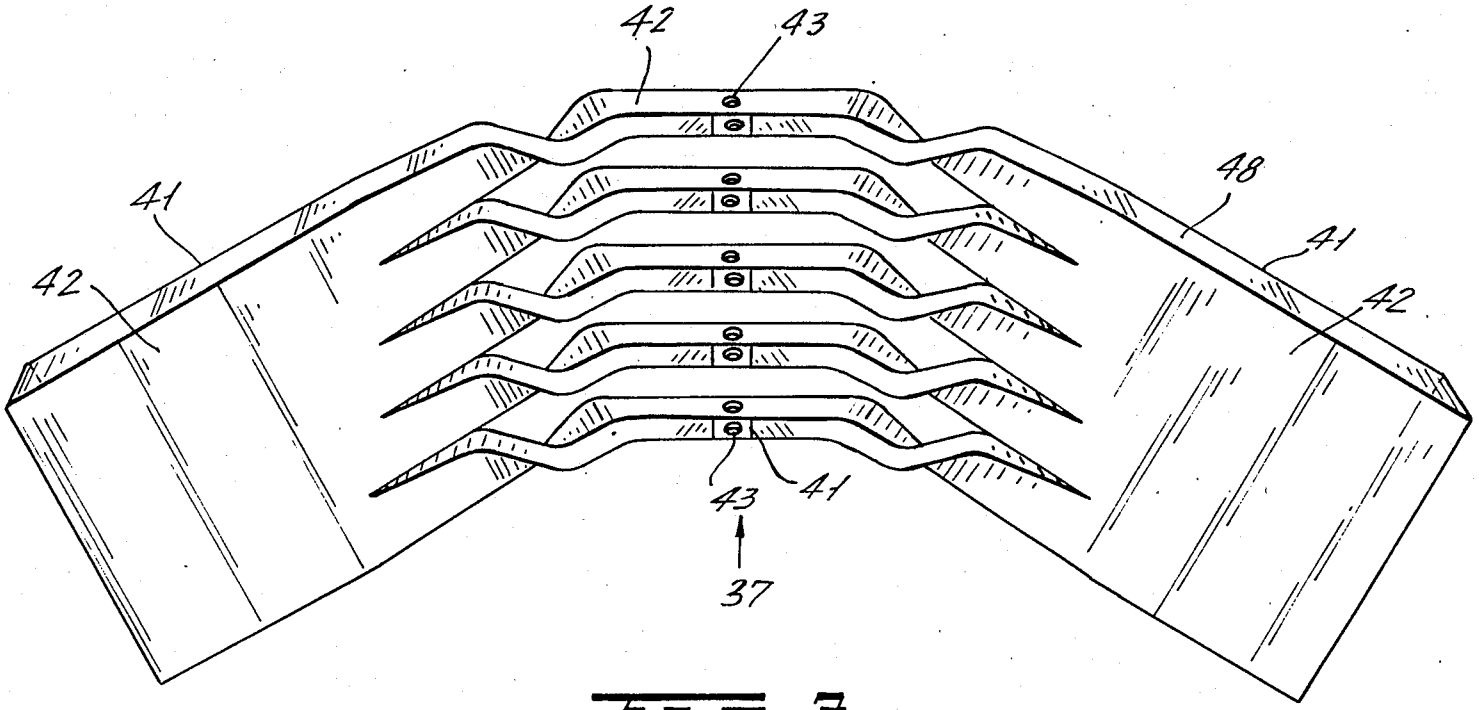
FIG. 3 is a view similar to FIG. 2 with shading added to provide a clearer illustration by increasing the contrast between elements.

As seen in FIG. 3, dielectric material 48 fills the space between plates 41, 42 except at the central portions of ribbons 41-1–42-5 having apertures 43 through which accelerating path 24 extends. The transit time for energy pulses is controlled by the dielectric constant of the material for insulator 48. Tapering of the space between plates 41 and 42, with spacing $g_1$ at injection region 36 being greater than spacing $g_2$ at accelerating region 37, controls the electric field at accelerating region 37. To further increase the electric field, each of the ribbons 41-1–42-5 has a width $W_1$ at its pulse injection end larger than its width $W_2$ at the accelerating region 37. If the ribbons are ended immediately after the accelerating region 37, as in FIG. 5, the voltage pulse will double and the gradient gain for the electric field is expressed mathematically as:

$$G = 2\epsilon_r^{\frac{1}{2}}\sqrt{\frac{g_1(g_1 + \omega_1)}{g_2(g_2 + \omega_2)}},$$

where G is the ratio between the value of the electric field applied to injection region 36 and the field appearing across the accelerating regions 43; $\epsilon_r$ is the relative dielectric constant; and $g_1$, $G_2$, $W_1$, $W_2$are the initial and final gap, and the initial and final width, respectively.

Figure 2:
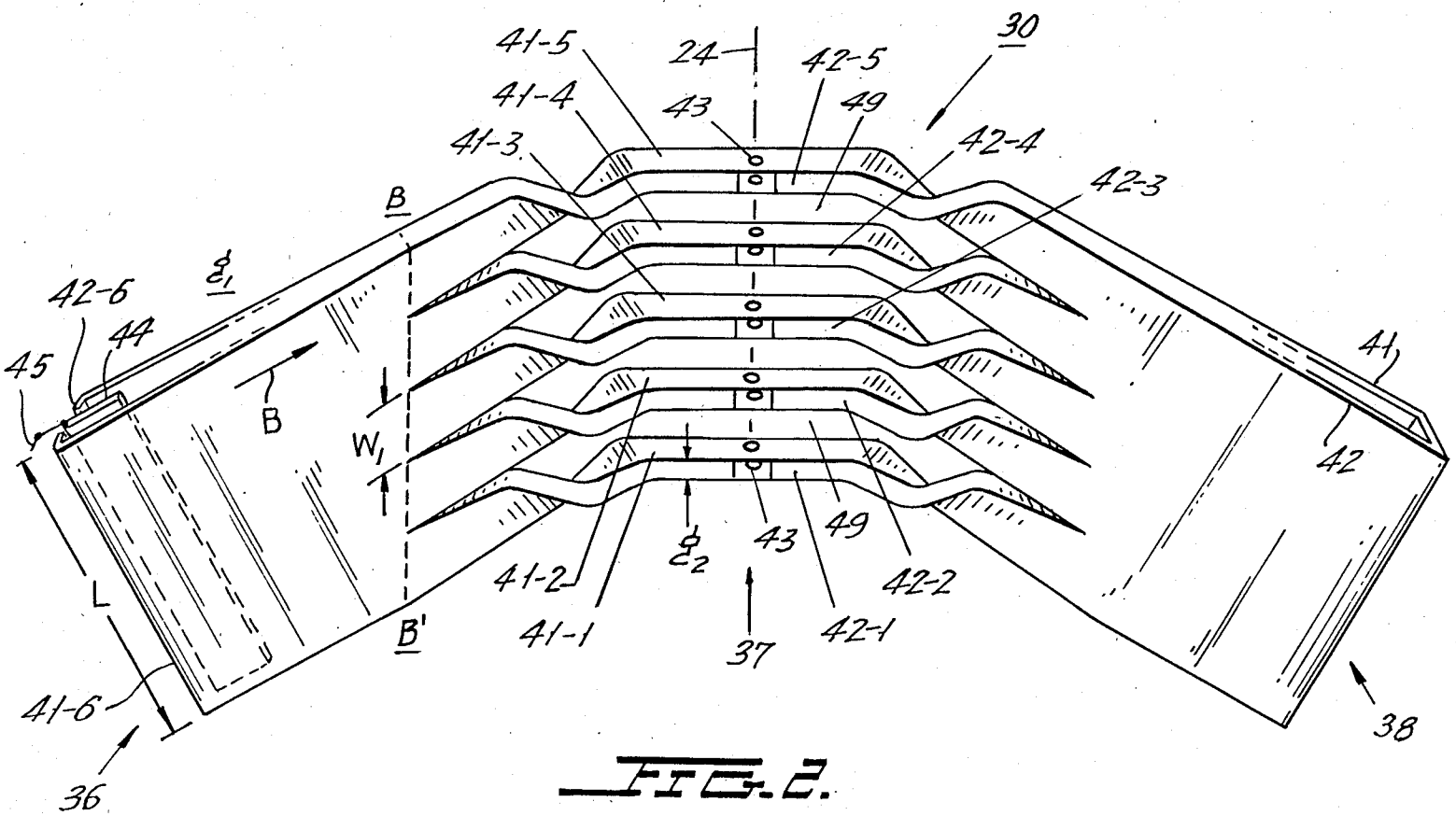
FIG. 2 is a perspective, partly schematic, of a LINAC constructed in accordance with teachings of the instant invention in which a parallel plate transmission line is utilized.
Figure 4:
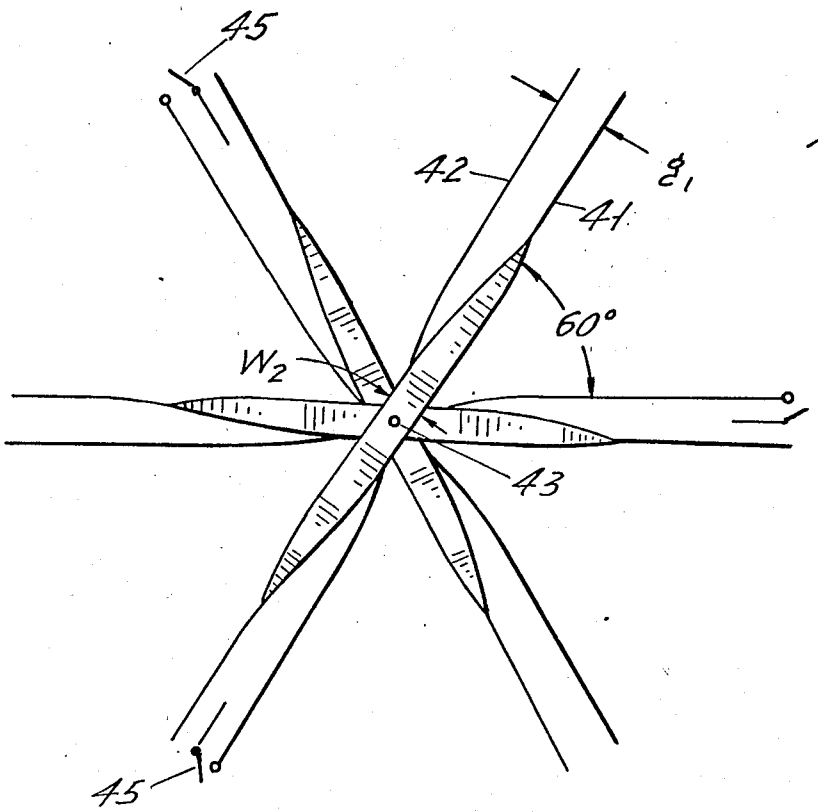
FIG. 4 is a schematic illustrating an embodiment of this invention wherein a plurality of the FIG. 2 structures are combined.

For the structure illustrated in FIGS. 2 and 3 the center of each of the ribbons 41-1–42-5 is so much narrower than the ends of the ribbons that the spaces 49 between adjacent accelerating gaps are large enough to accommodate additional accelerating gaps (see FIG. 4) to increase the average electric field and/or magnetic focusing elements (magnetic quadrupoles, sextupoles, etc.) to stabilize the electron beam. The FIG. 4 type of arrangement for accelerating gaps is useful in cancelling out magnetic field effects which result from the traveling pulse at the accelerating region 37. Such magnetic field results in an impulse that acts transverse to the electric field which is parallel to the direction of motion for the accelerating beam at path 24. To average the magnetic field to zero three structures similar to that in FIG. 2 are interlaced so that each of the spaces 49 seen in FIG. 2 are occupied by two additional accelerating gaps having apertures which are aligned with apertures 43 of FIG. 2 so that the accelerating path 24 remains linear.

Figure 5:
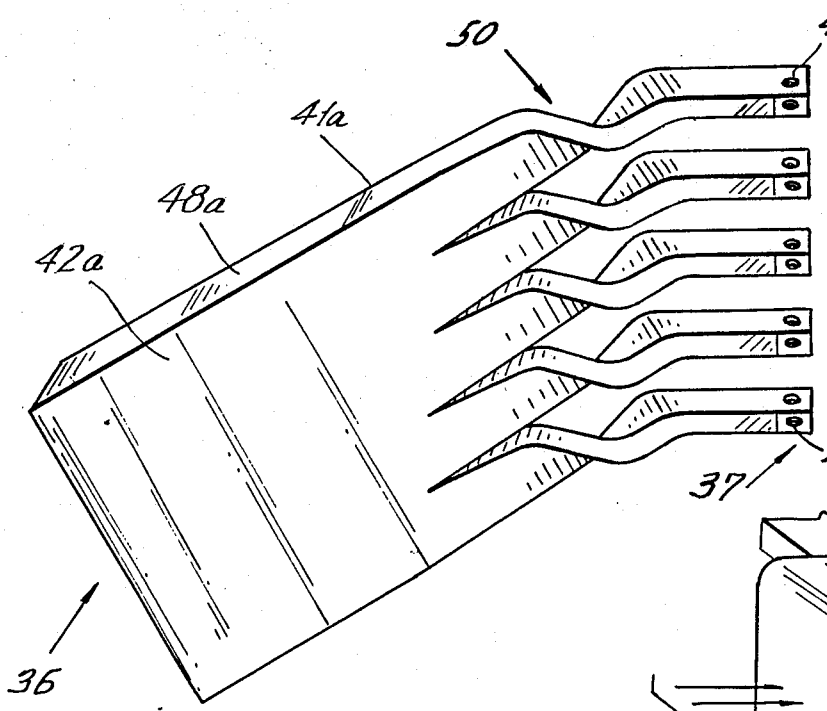
FIG. 5 is a perspective of a second embodiment of the instant invention, based on the embodiment illustrated in FIG. 2.

In the embodiment of FIG. 5 the terminating region to the right of accelerating region 37 in FIG. 3 is eliminated and the energy which is not used for particle acceleration is reflected back to power injection region 36. In the embodiment of FIG. 5 spaced plate conductors **41*a*, 42*a* are separated by dielectric material 48*a* and the ribbon like section at the right terminate at accelerating region 37**.

Figure 6:
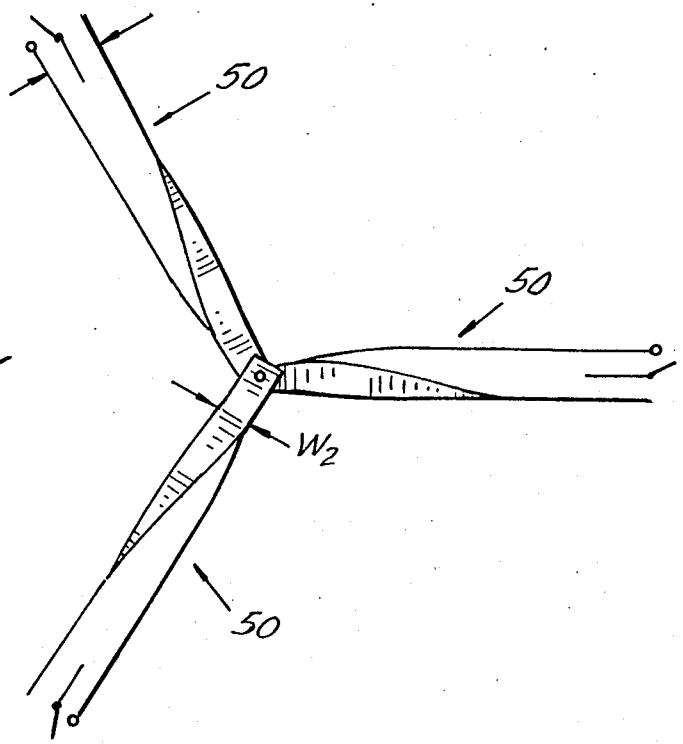
FIG. 6 is a schematic illustrating a modification of the embodiment in FIG. 5.

FIG. 6 illustrates a spoke like arrangement consisting of three of the transmission line particle accelerating devices 50 that are illustrated in FIG. 5 wherein there are six spokes radiating from the particle accelerating path that extends through aligned apertures 43.

Figure 8:
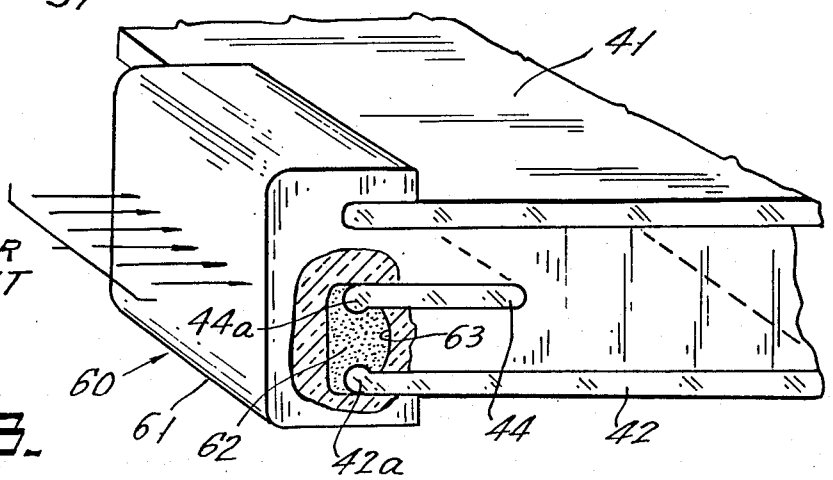
FIG. 8 is a schematic of a high speed switching device that is useful for injecting pulse power into a LINAC constructed in accordance with teachings of the instant invention.
Figure 7:
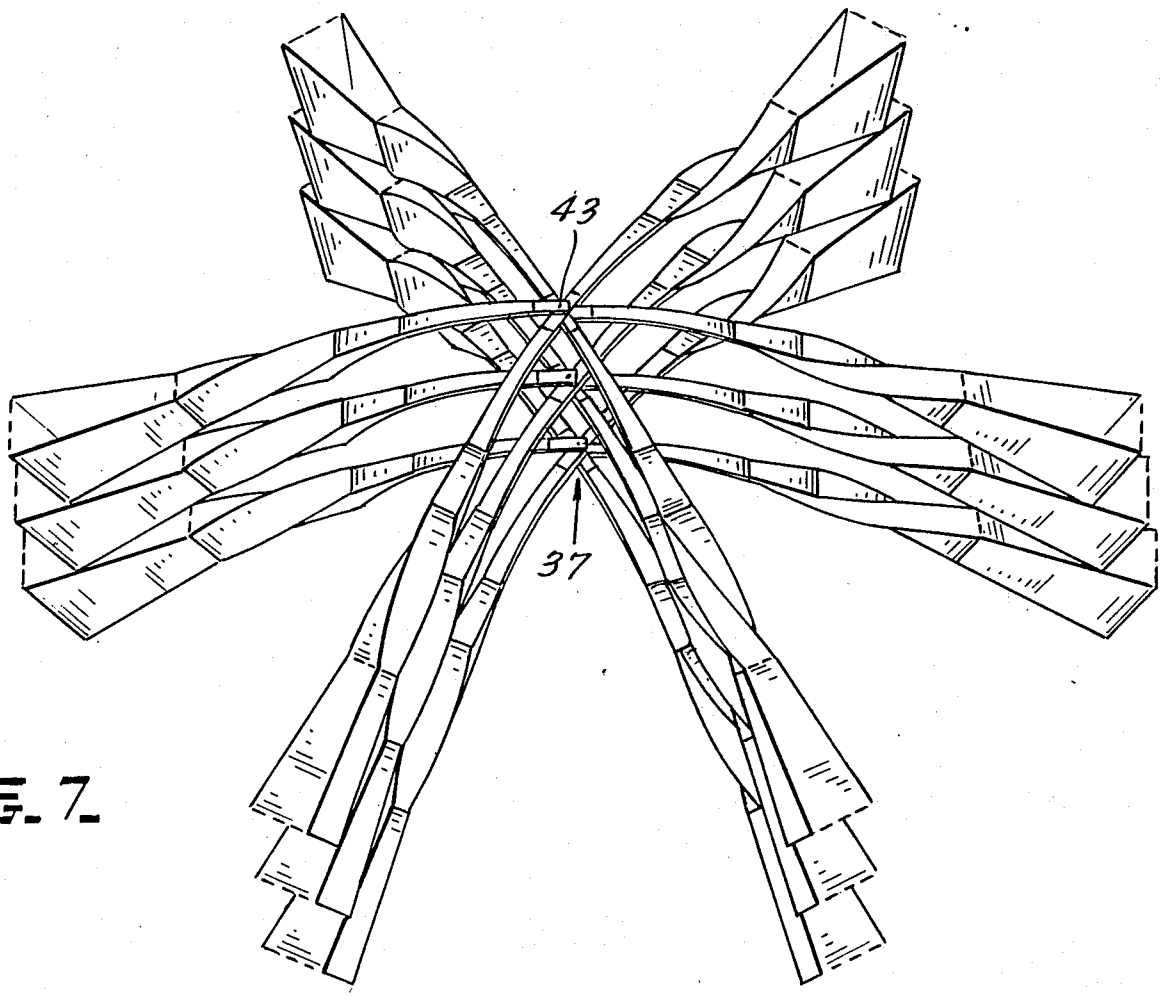
FIG. 7 is a CAD/CAM generated perspective of an embodiment similar to that in FIG. 4.

FIG. 8 illustrates a laser triggered switch 60 used for reliable ultrafast switching of relatively high currents at moderately high voltages, to inject power into LINACS of the type illustrated in FIGS. 1 through 7. More particularly, gas avalanche switch 60 of FIG. 8 is a Blumlein-type pulse forming network which includes shaped quartz element 61 that is transparent to UV light and is provided with cavity 63 that is filled with a gas 62 pressurized to say 300 Atm. Cavity 63 extends for approximately the width of storage electrode 44 whose shaped edge portion **44*a* is disposed within cavity 63. Shaped edge portion 42*a* of transmission line plate 42 is disposed within cavity 63 while plate 41 does not extend into cavity 63, edge portion 41*a* of plate 41 is disposed within slot 61*a* of quartz element 61. Portions of quartz element 60 are interposed between electrode 44 and plates 41, 42 and directly between plates 41, 42 in the region of electrode 44**.

Initial ionization of gas 62 results from laser light that is directed into cavity 63 and concentrated relatively close to anode electrode **44*a* of anode 44. This causes electrons to avalanche towards anode electrode 44*a*. The ionized region will spread away from the initial distribution because electrons produced by the avalanche will ionize the surrounding gas 62, and because the electrons are moving under the influence of the electric field. The displacement current of the electron avalanche will induce a pulse across plates or electrodes 41, 42**.

While the drawings do not illustrate evacuated regions, it should be apparent to those skilled in the art that accelerating path 24 extends through a region where vacuum is present, and switch 60 is also in a vacuum.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A linear accelerator including:

first means for emitting charged particles that travel along a linear path extending through a particle accelerating region;

second means defining a first plurality of accelerating gaps disposed in series at said accelerating region;

each of said accelerating gaps being defined by a pair of spaced electrodes disposed transverse to said path, and each of said electrodes having an aperture through which said path extends;

third means for generating energy pulses to power said accelerator;

transmission line means connecting said electrodes to a power injection region where said pulses are applied to said transmission line means to propagate therealong to said accelerating gaps;

said transmission line means including a plurality of line sections that are connected in parallel at said power injection region, and an individual one of said line sections being connected to each pair of said spaced electrodes;

said line sections being constructed to delay arrival of each of said pulses at said accelerating gaps in a predetermined sequence so that at each of said gaps as charged particles pass thereacross they are subjected to an accelerating force generated by an electric field which is derived from one of said pulses;

each of said line sections comprising elongated plate-like first and second conductors with a space therebetween.

2. A linear accelerator as set forth in claim 1 in which there is a dielectric medium occupying the space between said first and second conductors.

3. A linear accelerator as set forth in claim 2 in which the dielectric medium is a solid.

4. A linear accelerator as set forth in claim 1 in which the third means includes an avalanche type switch device.

5. A linear accelerator as set forth in claim 3 in which, at the injection region, the first conductors are generally in a first common plane and the second conductors are generally in a second common plane.

6. A linear accelerator as set forth in claim 5 in which said first and second conductors are twisted at locations between the injection and accelerating regions so that conductor portions at said accelerating region are generally in planes that are transverse to the common planes at said injection region.

7. A linear accelerator as set forth in claim 3 in which, at the accelerator region, said conductors of all said line sections are generally parallel to one another and are arranged in a stack.

8. A linear accelerator as set forth in claim 7 in which each of the conductors tapers gradually from end-to-end, being wider at the injection region than at the accelerating region.

9. A linear accelerator as set forth in claim 7 in which the dielectric medium has a thickness that tapers gradually from end-to-end, being thicker at the injection region than at the accelerating region.

10. A linear accelerator as set forth in claim 7 in which the dielectric medium possesses a dielectric constant that changes along the length of said transmission line means.

11. A linear accelerator as set forth in claim 1 in which the line sections are open circuited at their ends remote from the injection regions.

12. A linear accelerator as set forth in claim 1 in which each of said line sections includes a terminating portion that extends from said accelerating region to a terminating region;

said terminating portion being generally symmetrical with respect to an input portion of said line section which extends between the power injection and accelerating regions.

13. A linear accelerator as set forth in claim 7 in which each of said line sections includes a terminating portion that extends from said accelerating region to a terminating region;

said terminating portion being generally symmetrical with respect to the input portion of said line section which extends between the power injection and accelerating regions.

14. A linear accelerator as set forth in claim 1 also including a second and a third plurality of accelerating gaps each disposed in series at said accelerating region, and defined by a pair of spaced electrodes disposed transverse to said path and having aperture means through which said path extends;

adjacent gaps of said first plurality of gaps having substantial spaces therebetween;

each of said spaces having disposed therein a gap from each of the second and third plurality of accelerating gaps with each gap of the second plurality being disposed between a gap of the first plurality and a gap of the third plurality.

15. A linear accelerator as set forth in claim 14 also including transmission line means comprising a second plurality of line sections, one for each pair of electrodes defining the gaps of the second plurality, to conduct energy pulses thereto in a predetermined sequence coordinated with pulses applied to the gap of the first plurality; and a third transmission line means comprising including a third plurality of line sections, one for each pair of electrodes defining the gaps of the third plurality, to conduct energy pulses thereto in a predetermined sequence coordinated with pulses applied to the gaps of the first and second pluralities.

16. A linear accelerator as set forth in claim 15 in which the line sections extend radially from the accelerating region as a hub.

17. A linear accelerator as set forth in claim 1 in which the third means includes an avalanche type switch device.

* * * * *